United States Patent [19]

Doherty et al.

[11] Patent Number: 4,908,069

[45] Date of Patent: Mar. 13, 1990

[54] ALLOYS CONTAINING GAMMA PRIME PHASE AND PROCESS FOR FORMING SAME

[75] Inventors: Roger D. Doherty, Wynnewood; Rishi P. Singh, Philadelphia, both of Pa.

[73] Assignee: SPS Technologies, Inc., Newton, Pa.

[21] Appl. No.: 110,132

[22] Filed: Oct. 19, 1987

[51] Int. Cl.[4] ..... C22F 1/10

[52] U.S. Cl. ..... 148/2; 148/11.5 R; 148/11.5 N; 148/12.7 R; 148/12.7 N; 148/408; 148/410; 148/419; 148/425; 148/427; 148/428; 148/442

[58] Field of Search ..... 148/2, 11.5 R, 11.5 N, 148/12.7 R, 12.7 N, 442, 408, 410, 419, 425, 427, 428

[56] References Cited

U.S. PATENT DOCUMENTS

| | | | |
|---|---|---|---|
| 3,147,155 | 9/1964 | Lamb | 148/11.5 N |
| 3,356,542 | 12/1967 | Smith | 148/12.7 N |
| 3,420,660 | 1/1969 | Kawahata et al. | 148/419 |
| 3,620,855 | 11/1971 | Wagner et al. | 148/410 |
| 3,642,543 | 2/1972 | Owczarski et al. | 148/12.7 N |
| 3,645,799 | 2/1972 | Goue et al. | 148/11.5 N |
| 3,705,827 | 12/1972 | Muzyka et al. | 148/142 |
| 3,767,385 | 10/1973 | Slaney | 148/442 |
| 3,785,876 | 1/1974 | Bailey | 148/2 |
| 3,785,877 | 1/1974 | Bailey | 148/2 |
| 3,915,760 | 10/1975 | Wenderott et al. | 148/11.5 R |
| 3,972,752 | 8/1976 | Honnorat et al. | 148/162 |
| 3,982,973 | 9/1976 | Peters et al. | 148/11.5 N |
| 3,998,663 | 12/1976 | Wenderott et al. | 148/11.5 N |
| 4,110,131 | 8/1978 | Gessinger | 148/11.5 N |
| 4,121,950 | 10/1978 | Guimier et al. | 148/12.7 N |
| 4,304,613 | 12/1981 | Wang et al. | 148/11.5 N |
| 4,336,079 | 6/1982 | Owens | 148/11.5 N |
| 4,392,894 | 7/1983 | Pearson et al. | 148/11.5 N |
| 4,404,025 | 9/1983 | Mercier et al. | 148/11.5 N |
| 4,421,571 | 12/1983 | Kudo et al. | 148/11.5 N |
| 4,445,943 | 5/1984 | Smith, Jr. et al. | 148/12.7 N |
| 4,579,602 | 4/1986 | Paulonis et al. | 148/11.5 N |
| 4,591,393 | 5/1986 | Kane et al. | 148/11.5 N |
| 4,608,094 | 8/1986 | Miller et al. | 148/11.5 N |
| 4,609,528 | 9/1986 | Chang et al. | 148/11.5 N |

OTHER PUBLICATIONS

Hornbogen et al., Acta Metallurgica, vol. 15, 1967, 584 et seq.

Singh et al., Martensitic Transformation and Diffusional Stabilization of Martensite in High Strength Cobalt Alloy, Jul. 1987.

Slaney et al., Development of Multiphase Alloy MP159 Using Experimental Statistics, Metallography 16:137–160 (1983).

Guard et al., Alloying Behavior of $Ni_3Al$ (Gamma Prime Phase), Transactions of the Metallurgical Society of AIME, vol. 215, 10/59, 807 et seq.

*Primary Examiner*—R. Dean

*Attorney, Agent, or Firm*—Curtis, Morris & Safford

[57] ABSTRACT

A method of making a work-strengthenable alloy which includes a gamma prime phase which method comprises forming a melt comprising the following elements in percent by weight:

| | |
|---|---|
| molybdenum | 6–16 |
| chromium | 13–25 |
| iron | 0–23 |
| nickel | 10–55 |
| carbon | 0–0.05 |
| boron | 0–0.05 |
| cobalt | balance, at least 20, |

said alloy also containing one or more elements which form gamma prime phase with nickel, the electron vacancy number, $N_v$, of the alloy being defined by $$N_v = 0.61\ Ni + 1.71\ Co + 2.66\ Fe + 4.66\ Cr + 5.66\ Mo$$

wherein the respective chemical symbols represent the effective atomic fractions of the respective elements present in the alloy, said value not exceeding the value $$N_v = 2.82 - 0.017\ W_{Fe},$$

where $W_{Fe}$ is the percent by weight of iron in the alloy for those alloys containing no iron or less than 13 percent by weight iron and $W_{Fe}$ is 13 for alloys containing from 13–23 percent by weight iron; cooling said melt; and heating the alloy at a temperature of from 600°–900° C. for a time sufficient to form said gamma prime phase prior to strengthening said alloy by working it to achieve a reduction in cross-section of at least 5 percent; and alloys containing said gamma prima phase.

20 Claims, No Drawings

ALLOYS CONTAINING GAMMA PRIME PHASE AND PROCESS FOR FORMING SAME

Field of the Invention

The present invention relates to work-strengthenable alloys having a gamma prime phase, to alloys that have already been work-strengthened and which contain a substantial gamma prime phase, and to a process for making the alloys as aforesaid.

BACKGROUND OF THE INVENTION

Smith U.S. Pat. No. 3,356,542 granted Dec. 5, 1967 (the "Smith patent") is directed to cobalt-nickel base alloys containing chromium and molybdenum. These alloys are said to be corrosion resistant and capable of being work-strengthened under certain temperature conditions to have very high ultimate tensile and yield strengths. The patented alloys can exist in one of two crystalline phases, depending on temperature. They are also characterized by a composition-dependent transition zone of temperatures in which transformations between phases occur. At temperatures above the upper temperature limit of the transformation zone, the alloys are stable in the face-centered cubic ("fcc") structure. At temperatures below the lower temperature of the transformation zone, the alloys are stable in hexagonal close-packed ("hcp") form.

By cold working metastable face-centered cubic material at a temperature below the lower limit of the transformation zone, some of it is transformed into the hexagonal close-packed phase which is dispersed as platelets throughout a matrix of the face-centered cubic material. It is this cold working and phase-transformation which is indicated to be responsible for the ultimate tensile and yield strengths of the patented alloys.

It is characteristic of the Smith patent alloys that they are relatively expensive because of their high content of components such as nickel, molybdenum, and cobalt, and relatively low content of alloy components of lesser cost, such as iron. Iron may be present in the Smith patent alloys in amounts only up to 6% by weight for example.

In response to the demand for alloys less expensive than those of the Smith patent, the alloys disclosed in Slaney U.S. Pat. No. 3,767,385 granted Oct. 23, 1973 (the "Slaney patent") were developed. The alloys disclosed include elements, such as iron, in amounts which were formerly thought to result in the formation of disadvantageous topologically close-packed phases such as the sigma, mu or chi phases (depending on composition), and thus thought to severely embrittle the alloys. But, this disadvantageous result is said to be avoided with the invention of the Slaney patent. For example, the alloys of the Slaney patent are reported to contain iron in amounts from 6% to 25% while being substantially free of embrittling phases.

According to the Slaney patent it is not enough to constitute the patented alloys within the ranges of cobalt, nickel, iron, molybdenum, chromium, titanium, aluminum, columbium, carbon and boron specified. Rather, the alloys must further have an electron vacancy number, ($N_v$), which does not exceed certain fixed values in order to avoid the formation of embrittling phases.

By using such alloys, the Slaney patent states, cobalt-based alloys which are highly corrosion resistant and have excellent ultimate tensile and yield strengths can be obtained. These properties are disclosed to be imparted by formation of a platelet hcp phase in a matrix fcc phase. This is accomplished by working the alloys at a temperature below the lower temperature of a transition zone of temperatures in which transformation between the hcp phase and the fcc phase occurs.

Another alternative is the alloy described in Slaney U.S. Pat. application Ser. No. 893,634, filed Aug. 6, 1986 (the "Slaney application"), which is a continuation of U.S. Pat. application Ser. No. 638,985 filed Aug. 8, 1984 (now abandoned). The alloys disclosed in the Slaney application are said to retain satisfactory tensile and ductility levels and stress rupture properties at temperatures of about 1300° F. (700° C.). The alloys contain substantial amounts of cobalt, chromium and nickel, a maximum of 1 percent by weight iron, and optionally small amounts of titanium and columbium as well. In order to avoid formation of embrittling phases, such as the sigma phase, it is also disclosed that the electron vacancy number for the alloys disclosed in the Slaney application be no greater than 2.8. Again, the alloys are disclosed as being strengthened by working at a temperature which is below that the lower temperature of a transition zone of temperatures in which transformation between the hcp phase and the fcc phase occurs.

It is believed clear that strengthening of the alloys of the foregoing patents and application is attributed to cold working causing formation of hcp platelets in the fcc matrix, and optionally a subsequent heat-aging at a somewhat elevated temperature—for instance cold working, to obtain an approximately 5 to 70% reduction in thickness, and subsequent aging in the temperature range of 426°–732° C. for about 4 hours. There is no mention in any of the Smith and Slaney patents and Slaney application that strengthening should be achieved by formation of gamma prime phase in the alloys. However, as will be seen, the present invention is premised upon the recognition that advantageous mechanical properties (such as high strength), and high hardness levels, can be attained in certain alloy materials having high resistance to corrosion through formation of a gamma prime phase in those materials and the retention of a substantial gamma prime phase after the materials have been worked to cause formation of an hcp platelet phase in an fcc matrix.

SUMMARY OF THE INVENTION

It is an object of the invention to provide alloy materials having advantageous mechanical properties and hardness levels both at room temperature and elevated temperature.

It is another object of the present invention to provide alloys having high corrosion resistance, the mechanical properties and hardness levels of which compare favorably with those of alloys such as are disclosed in the above-identified Slaney patent and Slaney application, and further to provide a method for making such alloys.

It is yet another object of the present invention to provide alloys having the aforementioned mechanical properties and hardness levels, while still being substantially free of disadvantageous embrittling phases.

Accordingly, in one of its aspects, the invention is a method of making a work-strengthenable alloy which includes a gamma prime phase, which method comprises forming a melt comprising the following elements in percent by weight:

| | |
|---|---|
| molybdenum | 6–16 |
| chromium | 13–25 |
| iron | 0–23 |
| nickel | 10–55 |
| carbon | 0–0.05 |
| boron | 0–0.05 |
| cobalt | balance, constituting at least 20, |

said alloy also containing one or more elements which form gamma prime phase with nickel, the electron vacancy number, $N_v$, of the alloy being defined by $$N_v=0.61Ni+1.71\ Co+2.66\ Fe+4.66\ Cr+5.66\ Mo$$

wherein the respective chemical symbols represent the effective atomic fractions of the respective elements present in the alloy, said number not exceeding the value $$N_v=2.82\ -0.017\ W_{Fe},$$

where $W_{Fe}$ is the percent by weight of iron in the alloy for alloys containing no iron or up to 13 percent by weight iron and $W_{Fe}$ is 13 for alloys containing 13–23 percent by weight iron; cooling said melt; and heating the alloy at a temperature of from 600°–900° C. for a time sufficient to form said gamma prime phase, prior to strengthening of said alloy by working it to achieve a reduction in cross-section of at least 5 percent The invention is further in alloys made by this method.

In another aspect, the invention is an alloy which includes a substantial gamma prime phase as well as a hexagonal close-packed phase, said alloy comprising the following elements in percent by weight:

| | |
|---|---|
| molybdenum | 6–16 |
| chromium | 13–25 |
| iron | 0–23 |
| nickel | 10–55 |
| carbon | 0–0.05 |
| boron | 0–0.05 |
| cobalt | balance, constituting at least 20, |

said alloy also containing one or more elements forming gamma prime phase with nickel, the electron vacancy number, $N_v$, of the alloy being defined by $$N_v=0.61\ Ni+1.71\ Co+2.66\ Fe+4.66\ Cr+5.66\ Mo$$

wherein the respective chemical symbols represent the effective atomic fractions of the respective elements present in the alloy, said number not exceeding the value $$N_v=2.82-0.017\ W_{Fe}$$

where $W_{Fe}$ is the percent by weight of iron in the alloy for alloys containing no iron or less than 13 percent by weight iron and $W_{Fe}$ is 13 for alloys containing 13–23 percent by weight iron.

In yet another aspect, the present invention is a work-strengthenable alloy which, prior to strengthening by working to achieve a reduction in cross-section of at least 5 percent, includes a gamma prime phase, said alloy comprising the following elements in percent by weight:

| | |
|---|---|
| molybdenum | 6–16 |
| chronium | 13–25 |
| iron | 0–23 |
| nickel | 10–55 |
| carbon | 0–0.05 |
| boron | 0–0.05 |
| cobalt | balance, constituting at least 20, |

said alloy also containing one or more elements which form gamma prime phase with nickel, the electron vacancy number, $N_v$, of the alloy being defined by $$N_v=0.61\ Ni+1.71\ Co+2.66\ Fe+4.66\ Cr+5.66\ Mo$$

wherein the respective chemical symbols represent the effective atomic fractions of the respective elements present in the alloy, said number not exceeding the value $$N_v=2.82-0.017\ W_{Fe},$$

where is the percent by weight of iron in the alloy for alloys containing no iron or less than 13 percent by weight iron and $W_{Fe}$ is 13 for alloys containing 13–23 percent by weight iron.

Substantial advantage is conferred by practice of the present invention. When gamma prime phase is formed in the alloys disclosed in accordance with the present invention, those alloys exhibit (in addition to high corrosion resistance) high hardness levels and advantageous mechanical properties after working and subsequent aging. These hardness levels and mechanical properties (such as tensile and yield strength, and ductility) compare favorably with those exhibited by the alloys of the Smith and Slaney patents and Slaney application. Nevertheless, the alloys are substantially free of embrittling phases. Examples of these are the sigma, the mu and the chi phases; they are topologically close packed phases which need to be avoided because their appreciable presence is detrimental to important properties of the inventors' alloys.

DESCRIPTION OF CERTAIN PREFERRED EMBODIMENTS

The formation of the gamma prime phase in the alloys of the present invention is a central feature. That phase is typically an ordered face-centered cubic precipitate which forms within the alloy matrix. Once formed, it is stable up to temperatures of at least about 960° C. The discovery that gamma prime phase is beneficially formed in alloys obtained from the melt, prior to their being worked to achieve at least a 5 percent reduction in cross-section, is a distinguishing characteristic of the present invention. It is a further distinguishing characteristic that substantial gamma prime phase formation can be retained through working of the alloys of the invention and subsequent aging to provide substantial gamma prime phase in the worked-and-then-aged material, to go along with the hcp phase which is developed by that working. The survival of this gamma prime phase at high-temperature operating conditions confers desired strength properties on the alloys of the invention.

The gamma prime phase is preferably formed in an amount of 5–60 percent by volume of the alloy. It is especially preferred that the gamma prime phase constitute 30–60 percent by volume of the alloy The gamma prime phase is typically advantageously formed in amounts which are substantial. It is particularly advantageous that the amount of gamma prime phase which is retained in the worked and subsequently aged materials be substantial. In this regard, a substantial amount is that which when formed, is sufficient after working and aging to result in the aforementioned beneficial hardness levels and mechanical properties, such as strength especially at elevated temperature (although room temperature strength is also important). One way of characterizing substantiality of the amount of gamma prime phase is in terms of volume percent, for instance 5–60 volume percent and especially 30–60 volume percent as mentioned above. Another way, which in some instances is more convenient, is to determine the cross-sectional size of gamma prime phase particles using diffractometry, electron microscopy or both. Gamma prime phase particles formed in accordance with the present invention can be seen with an electron microscope (e.g., after initial heat treatment at 850° C. after 2 hours particles of 10 nanometers, and after 100 hours particles of 100 nanometers, can be seen (size measured in maximum dimension) in the worked and aged material). Although investigation of some work-strengthened materials not in accordance with the present invention (for instance, materials disclosed in the Smith and/or Slaney patents and in the Slaney application) has indicated that some gamma prime phase is present in the worked and then aged state, the amount is far smaller than attainable with the present invention and cannot be observed with electron microscopy (but is only discernable from a diffraction pattern), thus indicating its insubstantiality. It is questionable whether such phase can survive to make any beneficial contribution to properties at high-temperature operating conditions.

As is clear from the foregoing, in the present invention one element utilized in the formation of gamma prime phase is nickel. It is generally incorporated in an amount of from 10–55 percent by weight of the alloy. A minimum amount of, say 18 or 20 percent by weight is preferred, and a minimum amount of 25 percent by weight is especially preferred.

Also incorporated are elements forming gamma prime phase with nickel, which are suitably used either separately or in various combinations of two or more. These elements are typically aluminum, titanium and/or columbium. However, tantalum, vanadium, silicon and tungsten may also be utilized. Another possibility is zirconium, although this element would normally be used in combination with at least one of the other elements. Such elements are typically included in the alloy in a total amount ranging up to and including 10 percent by weight; normally whatever the weight percent of this total amount, it should not exceed about 20 atomic percent of the alloy. The total amount of such elements often suitably ranges from 2 to 6 percent by weight. For instance, aluminum can be incorporated in an amount from 0–5 percent by weight, titanium in an amount from 0–5 percent by weight and columbium in an amount from 0–10 percent by weight. Tantalum is very expensive, and so is usually not used in pure form as a component of the gamma prime phase formers. However, it is found in columbium ore and is at times, therefore, a component of the gamma prime phase. In certain preferred embodiments, aluminum is utilized in amounts on the order of 2–3 percent by weight, and as high as 5 percent by weight, with somewhat decreased amounts of columbium (such as up to 2 percent by weight) and/or titanium (such as up to 3 percent by weight). While all of the gamma prime phase embodiments of the present invention are candidates for applications in which the alloy is exposed for long periods of time to high temperature under stress (such as in bolt applications), it is thought that use of the aforementioned relatively high aluminum content embodiments will be particularly useful in those situations to impart long-term strength at high temperature.

It is additionally to be noted that in certain embodiments of the invention the lower limit in iron content is at least 6, and preferably greater than 6, percent by weight. Also, as mentioned previously, carbon and/or boron are suitably incorporated in the alloys of the present invention. A preferred range for the content of each of these components is 0–0.03 percent by weight.

As previously mentioned, not all of the alloy compositions falling within the general ranges set forth in the preceding disclosure are suitable. In certain of those compositions one or more embrittling phases are normally formed; such compositions do not lend themselves to practice of the invention.

It is necessary, in addition to selecting an alloy composition within the specified ranges, to select a composition having an acceptable electron vacancy number as set forth in the preceding disclosure. In this connection, the "effective atomic fraction" of elements set forth in the formula used to calculate the electron vacancy number takes into account the postulated conversion of a portion of the metal atoms present, particularly nickel, into compounds of the type $Ni_3X$ (such as gamma prime phase materials). For purposes of defining compositions suitable for practicing the present invention, the term "effective atomic fraction" is given the meaning set forth in this and the following explanatory paragraphs. It is assumed in defining (and calculating) the effective atomic fraction that all of the materials referred to previously as those capable of forming gamma prime phase with nickel actually do combine with nickel to form $Ni_3X$.

For the alloys of the present invention, the total atomic percent of each of the elements present in a given alloy is first calculated from the weight percent ignoring any carbon and/or boron in the composition. Each atomic percentage represents the number of atoms of an element present in 100 atoms of alloy. The number of atoms/100 (or atomic percentage) of elements forming gamma prime phase with nickel is totalled and multiplied by 4 to give an approximate number of atoms/100 involved in Nihd 3X formation. This figure, however, must be adjusted.

R. W. Guard et al., in "The Alloying Behavior of $Ni_3Al$ (Gamma-Prime Phase)," Met. Soc. AIME 215, 807 (1959), have shown that cobalt, iron, chromium, and molybdenum enter such an $Ni_3X$ compound in amounts up to 23, 15, 16, and 1 percent, respectively. To approximate the number of atoms/100 of each of these metals which are also "tied up" in the $Ni_3X$ phase and are unavailable for formation of non-$Ni_3X$ matrix alloy, the product of the maximum percent solubility of each metal in $Ni_3X$, its atomic fraction in the alloy under consideration, and the total number of atoms of $Ni_3X$ possible in 100 atoms of alloy is found.

The number of atoms of Ni, Co, Fe, Cr, and Mo in 100 atoms of alloy, respectively, are then corrected by subtraction of the figures representing the amount of each of these metals in the $Ni_3X$ phase. The difference approximates the number of atoms per 100 of the nominal alloy composition which are effectively available for matrix alloy formation. Since this total number is less then 100, the "effective atomic percent" of each of the elements—based on this total—is now calculated. The effective atomic fraction, which is the quotient of the effective atomic percent divided by 100, is employed in the determination of $N_v$ for these alloys. This calculation is exemplified in detail in Slaney U.S. Pat. No. 3,767,385 mentioned previously. As can be appreciated, the maximum allowable electron vacancy number is an approximation intended to serve as a tool for guiding the invention's practitioner. Some compositions for which the electron vacancy number is higher than the calculated "maximum" may also be useful in practicing the invention. These can be determined empirically, once the ordinarily skilled worker is in possession of the present subject matter.

Certain alloy compositions are preferred for the practice of the present invention.

One preferred range of compositions comprises 23–58 percent by weight cobalt, 15–21 percent by weight chromium, 0–23 percent by weight iron, 6–12 percent by weight molybdenum, 1–3 percent by weight aluminum, 0.4–5 percent by weight titanium, 0.5–2 percent by weight columbium, 0–0.03 carbon, 0–0.03 boron, and 18–55 percent by weight nickel.

Another more specific range of compositions comprises 18–30 percent by weight nickel, 6–12 percent by weight molybdenum, 18–22 percent by weight chromium, 7–10 percent by weight iron, 2–4 percent by weight titanium, 0.1–0.7 percent by weight aluminum, 0.1–1 percent by weight columbium, 23–58 percent by weight cobalt, 0–0.03 percent by weight carbon and 0–0.03 percent by weight boron.

The following are some additional specific compositions (comprising the elements listed below in percent by weight) which are suitably utilized in practicing the present invention:

| | Co | Ni | Cr | Mo | Ti | Nb | Fe | Al | C | B |
|---|---|---|---|---|---|---|---|---|---|---|
| MP159 | 35.6 | 25.5 | 19 | 7 | 3 | 0.6 | 9 | 0.2 | .04 max | .03 |
| MPXX | 36.3 | 30.9 | 19.4 | 7.3 | 3.8 | 1.2 | 1.0 | 0 | <.01 | <.01 |
| SMP #1 | 35.3 | 34.2 | 15.2 | 8.8 | 3.8 | 1.6 | 0.1 | 1 | .01 | .01 |
| SMP #2 | 35.2 | 33.7 | 15 | 8.9 | 4.6 | 1.6 | 0 | 1 | .02 | .02 |

The gamma prime phase typically appears in particulate form in the alloy. The particle size of the gamma prime phase in the alloy can vary. In general, it should not be so large as to cause the mechanical properties of the alloys to be appreciably degraded. Typically, the particles of the gamma prime phase are of size up to and including one micron. In certain advantageous embodiments, the particles are of two different size distributions. That is, the particles are made up of one fraction ranging in size up to and including 30 nanometers, and another fraction ranging in size from above 30 nanometers up to and including one micron. The particles of the two fractions are suitably intermingled or dispersed among one another in the alloy, preferably uniformly throughout the alloy.

The gamma prime phase is generally formed in accordance with the present invention by heat treating an alloy having a composition as previously described at a temperature of from 600°–900° C. Temperatures higher than 900° C. are not favored; indeed at about 960° C. the gamma prime phase can become unstable and may begin to re-dissolve. In many instances it has been found that the higher the temperature, the shorter the time taken to grow gamma prime phase particles to the desired size, and attain the desired amount of gamma prime phase. Conversely, the lower the temperature, the longer the time which must be taken to achieve the desired particle size and amount. At the upper end of the temperature range (about 900° C.), the alloys of the present invention are typically subjected to time-at-temperature of 2–20 hours. At the lower end of the temperature range (about 600° C.), the time-at-temperature is typically 40–400 hours. A preferred temperature range for aging is 750°–850° C. In this temperature range a typical aging period is 100 hours. However, this time will vary based upon the desired particle size and volume fraction of the gamma prime phase and can be in the range of from 4 to 150 hours.

The alloy composition is suitably prepared, for instance, by conventional ingot-formation techniques or by powder metallurgy techniques. Thus, the alloys can be first melted, suitably by vacuum induction melting, at an appropriate temperature, and then cast as an ingot. Alternatively, the molten alloy can be impinged by a gas jet or on a surface to disperse the melt as small droplets to form powders. Powdered alloys of this sort can, for example, be hot- or cold-pressed into a desired shape and then sintered according to techniques known in powder metallurgy. Coining is another powder metallurgy technique which is available, along with hot isostatic pressing and "plasma spraying" (the powdered alloy is sprayed hot onto a substrate to which it adheres, and then cold worked in situ by suitable means such as swaging, rolling or hammering).

Advantageously, the preliminary heat treatment described above, which causes the formation of gamma prime phase, is followed by working of the alloy. For instance, this can be a cold working operation, carried out either at room temperature or at elevated temperatures below the temperature at which martensite begins to form in the alloys of the invention, that is, below the lower temperature limit of the transition zone in which transformation between the hcp and fcc phases takes place.

Cold working generally take place at a temperature below the lower temperature of the temperature zone for transformation from the high-temperature face-centered cubic phase to the low-temperature stable hexagonal close-packed phase. Cold working is conveniently effected at ambient temperatures which may vary in a conventional mill from about −18° C. to 43° C., for example. These ambient temperatures are well below the lower temperature of the transition zone for all alloys encompassed by the present invention.

Should working at a temperature above ambient temperature be desired, the temperature limits of the transformation zone can be quite simply determined for any particular alloy composition empirically. Technique for doing this is known to those of ordinary skill in the art;

an example is given in U.S. Pat. No. 3,767,385 to Slaney, which has been discussed heretofore.

Furthermore, the alloys can be worked or deformed at temperatures below room temperature as well.

The working or deformation operation is carried out by any suitable technique; examples are rolling, extrusion, drawing, swaging, and the like. Preferably, after preliminary heat treatment to form the gamma prime phase, the alloys are worked to obtain a reduction in cross-section of as much as 70%. However, with certain of the alloys encompassed within the present invention it will not be feasible to work or deform to such a great degree. A typical reduction in cross-section is from 5 to 50%. In certain embodiments, the desired effect can be attained with a reduction in cross-section of between about 35 and 45 percent. In any event, an amount of working sufficient to cause the conversion of metastable fcc phase into platelets of stable hcp phase is employed. Such conversion causes a distribution of the hcp platelets in the fcc phase and is believed to result in high strength, for instance tensile strength, of the alloys. It is noteworthy that the greater is the degree of working and the higher is the ultimate tensile strength of the alloys, the lower the ductility becomes. Thus, when worked to increase their strength such materials lose ductility. While this phenomenon can ordinarily pose a troublesome problem, the alloys of the present invention which contain elements forming gamma prime phase with nickel are such that a high ultimate tensile strength (for instance 188–269 ksi) is produced with a lower degree of working. Thus a greater preservation of ductility at elevated temperatures is attained than in alloys free of the elements forming gamma prime phase with nickel.

After working, the alloys are suitably aged to increase their strength even more. This aging treatment is typically carried out at a temperature of 550°–800° C., and ordinarily over a period of from 1 to 6 hours. A preferable aging temperature range is from 600 ° to 700° C., for a preferred time of from 2 to 4 hours. After this aging the materials are cooled as appropriate, such as by air-cooling.

A better understanding of the present invention and of its many features, advantages and objects will be had by reference to the following specific examples, given by way of illustration.

EXAMPLES

An alloy designated MPXX (a registered trademark of SPS Technologies, Inc.), having the composition mentioned previously herein, was employed for testing. Samples of the alloy in the recrystallized state were subjected to various processing conditions, with the exception of the material tested in the recrystallized state, as set forth in the following tables. The values obtained at room temperature are an average of results obtained in two or more tests. Values obtained at elevated temperature were those generated in a single test. Those instances in which the alloy was "aged" and then deformed worked, e.g., by swaging) are examples of the present invention.

In the first table below the results obtained when measuring mechanical properties, such as yield strength ("YS"), ultimate tensile strength ("UTS") and percent elongation (% elong.) are presented.

| PROCESSING | Y.S | UTS | % elong |
|---|---|---|---|
| MPXX, aged at 800° C. for 12 hrs., 0% deformation | 123 | 190 | 40 |
| MPXX, 19% swaged, aged at 850° C. for 6 hrs. | 176 | 213 | 7 |
| MPXX, aged at 850° C. for 6 hrs., 34% swaged | 228 | 269 | 10 |
| MPXX, aged at 850° C. for 6 hrs., 289 34% swaged, aged at 700° C. for 3 hrs. | 290 | 4 | |
| MPXX, (recrystallized) | 48 | 115 | 78 |
| MPXX, 48% worked | 209 | 250 | 11 |
| MPXX, 49% worked, aged at 700° C. for 4 hrs. | 303 | 311 | 3 |
| MPXX, 36% worked, aged at 700° C. for 4 hrs. | 226 | 242 | 16 |

The second table presents results obtained in testing for creep rupture properties:

| | |
|---|---|
| 36% worked, aged at 650 for 4 hrs., creep rupture at 700° C., 100 hrs. | 96 ksi |
| Aged at 850° C. for 6 hrs., 34% swaged, aged 700° C. for 3 hrs. >100 hrs. | 107 ksi |
| 36% worked, aged at 650 for 4 hrs., creep rupture at 650° C., 1000 hrs. | 106 ksi |
| Aged 850° C. for 6 hrs., swaged, aged 750° C. for 3 hrs., creep rupture at 650° C., >1000 hrs. | 115 ksi |

The terms and expressions employed herein are used as terms of description and not of limitation, and there is no intention in the use of such terms and expressions of excluding any equivalents of the features shown and described or portions thereof, its being recognized that various modifications are possible within the scope of the invention.

We claim:

1. A method of making a work-strengthenable alloy which includes a gamma prime phase, which method comprises forming a melt consisting essentially of the following elements in percent by weight:

| | |
|---|---|
| molybdenum | 6–16 |
| chromium | 13–25 |
| iron | 0–23 |
| nickel | 10–55 |
| carbon | 0–0.05 |
| boron | 0–0.05 |
| cobalt | balance at least 20, |

and one or more elements which form gamma prime phase with nickel, the electron vacancy number, $N_v$, of the alloy being defined by $$N_v = 0.61\ Ni + 1.71\ Co + 2.66\ Fe + 4.66\ Cr + 5.66\ Mo$$

wherein the respective chemical symbols represent the effective atomic fractions of the respective elements present in the alloy, said value not exceeding the value $$N_v = 2.82 - 0.017\ W_{Fe},$$

where $W_{Fe}$ is the percent by weight of iron in the alloy for those alloys containing no iron or less than 13 percent by weight iron and $W_{Fe}$ is 13 for alloys containing from 13–23 percent by weight iron; cooling said melt; and heating the alloy at a temperature of from 600°–900° C. for a time sufficient to form said gamma prime phase, prior to strengthening said alloy by working it to achieve a reduction in cross-section of at least 5 percent.

2. An alloy made by the method defined in claim 1.

3. A method as defined in claim 1, wherein the alloy is heated for a time sufficient to form an amount of said gamma prime phase which constitutes at least 5–60 percent by volume of the alloy.

4. An alloy made by the method defined

5. A method as defined in claim 1, wherein is heated for a time sufficient to form gamma prime phase into particles of size up to and including 1 micron.

6. An alloy made by the method defined in claim 5.

7. A method as defined in claim 1, wherein the alloy is heated for a time sufficient to form the gamma prime phase into particles comprising at least two different fractions, a first fraction being of particles sized up to and including 30 nanometers and a second fraction being of particles sized greater than 30 nanometers and up to and including 1 micron.

8. An alloy made by the method defined in claim 7.

9. A method as defined in claim 1, which further comprises working said work-strengthenable alloy at a temperature below the lower temperature limit of the hcp-fcc phase-transformation zone to achieve a reduction in cross-section of from 5–70%.

10. An alloy made by the method defined in claim 9.

11. A method as defined in claim 9, wherein the worked alloy is aged at a temperature of from 550°–800° C.

12. An alloy made by the method defined in claim 11.

13. A method as defined in claim 1, wherein the iron content is greater than 6 percent by weight.

14. An alloy made by the method defined in claim 13.

15. A method as defined in claim 1, wherein said one or more elements which form gamma prime phase with nickel are selected from the group consisting of aluminum, titanium, columbium, tantalum, vanadium, silicon, zirconium and tungsten.

16. An alloy made by the method defined in claim 15.

17. A method as defined in claim comprises the following elements in percent

| | |
|---|---|
| cobalt | 23–58 |
| molybdenum | 6–12 |
| chromium | 15–21 |
| iron | 0–23 |
| aluminum | 1–3 |
| titanium | 0–5 |
| columbium | 0–2 |
| nickel | 18–55 |
| carbon | 0–0.03 |
| boron | 0–0.03 |

and the electron vacancy number, $N_v$, of the alloy is as defined in claim 1.

18. An alloy made by the method defined in claim 17.

19. A method as defined in claim 1, wherein the alloy comprises the following elements in percent by weight:

| | |
|---|---|
| cobalt | 23–58 |
| molybdenum | 6–12 |
| chromium | 18–22 |
| iron | 7–10 |
| titanium | 2–4 |
| aluminum | 0.1–0.7 |
| columbium | 0.1–1 |
| nickel | 18–30 |
| carbon | 0–0.03 |
| boron | 0–0.03, |

and the electron vacancy number, $N_v$, of the alloy is as defined in claim 1.

20. An alloy made by the method defined in claim 19.

* * * * *

UNITED STATES PATENT AND TRADEMARK OFFICE

CERTIFICATE OF CORRECTION

PATENT NO. : 4,908,069

DATED : March 13, 1990

INVENTOR(S) : Roger D. Doherty and Rishi P. Singh

It is certified that error appears in the above-identified patent and that said Letters Patent is hereby corrected as shown below:

Claim 4, column 11, line 8, after "defined" insert -- in claim 3 --;

Claim 5, column 11, line 9, after "wherein" insert -- the alloy --;

Claim 17, column 12, line 4, after "claim" insert -- 1, wherein the alloy --;
line 5, after "percent" insert -- by weight: --

Signed and Sealed this

Eleventh Day of December, 1990

*Attest:*

*Attesting Officer*

HARRY F. MANBECK, JR.

*Commissioner of Patents and Trademarks*